US006898842B2

(12) United States Patent
Kasahara et al.

(10) Patent No.: US 6,898,842 B2
(45) Date of Patent: May 31, 2005

(54) METHOD FOR MANUFACTURING A CONTINUOUS-LENGTH SWITCH

(75) Inventors: Takeshi Kasahara, Chiba-ken (JP); Uhei Arakawa, Tokyo (JP); Toshiaki Horikoshi, Tokyo (JP); Takaki Natsugiri, Saitama-ken (JP)

(73) Assignee: Tokyo Sensor Co., Ltd., Tokyo (JP)

( * ) Notice: Subject to any disclaimer, the term of this patent is extended or adjusted under 35 U.S.C. 154(b) by 105 days.

(21) Appl. No.: 10/213,106

(22) Filed: Aug. 7, 2002

(65) Prior Publication Data

US 2002/0184752 A1 Dec. 12, 2002

Related U.S. Application Data

(62) Division of application No. 09/572,696, filed on May 16, 2000, now Pat. No. 6,455,793.

(30) Foreign Application Priority Data

Jun. 25, 1999 (JP) ..... 11-4644
Sep. 9, 1999 (JP) ..... 11-256225
Dec. 3, 1999 (JP) ..... 11-344445

(51) Int. Cl.[7] ..... H01H 11/00; H01H 11/02; H01H 11/04; H01H 65/00

(52) U.S. Cl. ..... 29/622; 29/831; 29/846; 200/85 R; 200/86 R; 340/573; 340/667

(58) Field of Search ..... 29/622, 831, 846; 200/85 R, 86 R; 340/573, 667

(56) References Cited

U.S. PATENT DOCUMENTS

| | | | | |
|---|---|---|---|---|
| 2,796,484 A | | 6/1957 | Wolf | |
| 2,896,042 A | * | 7/1959 | Koenig | 200/86 R |
| 2,938,977 A | | 5/1960 | Koenig | |
| 3,243,540 A | | 3/1966 | Miler | |
| 3,270,160 A | | 8/1966 | Koenig | |
| 3,412,224 A | | 11/1968 | Koenig | |
| 3,718,791 A | | 2/1973 | Szablowski | |
| 3,812,313 A | | 5/1974 | Wolf et al. | |
| 3,867,595 A | | 2/1975 | Ramsey et al. | |
| 4,893,048 A | | 1/1990 | Farrall | |
| 5,118,910 A | * | 6/1992 | Duhon et al. | 200/86 R |
| 5,164,558 A | * | 11/1992 | Huff et al. | 200/83 R |
| 5,260,530 A | | 11/1993 | Duhon et al. | |

* cited by examiner

*Primary Examiner*—Carl J. Arbes
*Assistant Examiner*—Tim Phan
(74) *Attorney, Agent, or Firm*—Wenderoth, Lind & Ponack, L.L.P.

(57) ABSTRACT

Disclosed is a method for manufacturing a continuous-length switch that comprises first and second electrodes. The method comprises covering at least a first surface of a first electrode with an insulating material. Then, a portion of the insulating material from the first surface of the first electrode is removed so as to provide an exposed portion of the first electrode. And then, a second electrode is placed on the insulating material and over the exposed portion of the first electrode.

7 Claims, 13 Drawing Sheets

(In spread state)

(In wound-up state)

METHOD FOR MANUFACTURING A CONTINUOUS-LENGTH SWITCH

This application is a divisional of U.S. application Ser. No. 09/572,696, filed May 16, 2000 now U.S. Pat. No. 6,455,793.

BACKGROUND OF THE INVENTION

1. Field of the Invention

The present invention relates to a continuous-length switch which is operated under the load of a human being, an animal, a substance or the like to electrically detect the existence thereof.

The present invention also relates to a continuous-length switch which is to be used for detecting contact of a substance or the like and is excellent in durability.

The present invention also relates to a method for manufacturing the switch as described above.

2. Prior Art

Conventional continuous-length switches generally have a construction in which both ends of a pair of opposed electrode plates are insulated, and one of the electrode plates, i.e. an upper electrode plate 151, for example, has been worked to have an odd-shaped geometry such that a linear portion of the electrode plate 151 is interrupted, as shown in FIG. 14, to increase sensitivity of the switch. With such a geometry of the upper electrode plate 151, the edges are not linear, but rather are interrupted, which presents the following problems.

A part of the upper electrode plate 151 may get beneath the end insulating material when heavily deformed by an external force, which results in short-circuiting of the switch, which is a fatal fault.

When a lead wire is to be drawn out, the geometry in the direction along the breadth of the switch may be varied, and drawing the lead wire out may cause the switch to be stretched like a spring, depending upon a cutting location. Therefore, a precision end working as a secondary working for prevention of this stretching may have to be provided at the drawing-out location.

With a machine tool or the like, a safety mat M which has a continuous-length switch connected in series is used to assure operator safety. In this case, a four-wire type disconnection detection circuit which uses a power supply 160, a current limiting resistor R, and a relay 161 for detecting disconnection between the upper electrode plate 151 and a lower electrode plate 152 that is opposed to the upper electrode plate, as shown in FIG. 15, is employed.

Because the upper electrode plate 151 through which a current flows is odd-shaped as shown in FIG. 15, its line length is approximately two times as long as that which would be obtained if the electrode plate were linear. Therefore, when this four-wire type disconnection detection circuit is used for carrying out disconnection detection, the electrical resistance is increased, which results in an increased power loss.

When the operator arrives on the safety mat M, a wire is disconnected, the power supply 160 fails or a coil 162 is deenergized, resulting in contacts 161*a* for the relay 161 being opened, which allows the power fed to the machine tool or the like to be shut off.

However, in this case, the four-wire type disconnection detection circuit must always be supplied with a current to energize the coil 162 for the relay 161, and therefore, a problem is presented in that the power loss due to the circuit resistance cannot be avoided.

Another conventional continuous-length switch 250 generally has a construction with which both ends of an opposed upper electrode plate 251 and lower electrode plate 252 are insulated with an insulator 255 as shown in FIG. 33 to FIG. 35. As the geometry of either one of the upper electrode plate 251 and lower electrode plate 252, i.e., the upper electrode plate 251 for example, a concave and convex geometry as shown in FIG. 36 has been adopted to enhance the sensitivity associated with some switches.

The geometry of this upper electrode plate 251 can be easily deformed if a force "f" in the direction of a tensile load is applied to the upper electrode plate. Therefore, a method which winds a string 253 around the circumferences of the upper electrode plate 251 and lower electrode plate 252, and fixes the string 253 thereto with an adhesive tape has been adopted.

However, such a continuous-length switch 250 presents problems, such as an increase in the number of manufacturing processes required, and the upper electrode plate 251 getting beneath the insulator 255 which results in a short-circuit.

Although it is not shown, an upper electrode plate with which polygonal holes are arranged at fixed intervals along a center line in the longitudinal direction of the electrode plate has been adopted.

If such an upper electrode plate is used, the need for steps of winding a string around the upper electrode plate and the lower electrode plate, and fixing the string to the electrode plates with an adhesive tape is eliminated, thereby resulting in the manufacturing process being simplified.

However, with the upper electrode plate having such a configuration, a problem is that the electrode plate can be stretched and contracted only within a small range based on its metallic elasticity when a force in the longitudinal direction is applied.

As a result of this, when this continuous-length switch is wound up for manufacturing, transporting, construction, storing, or the like, one electrode plate may be buckled and plastically deformed, resulting from the difference between the inside and outside diameters of the upper electrode plate and the lower electrode plate. Therefore, for a continuous-length switch having a long overall length, there sometimes arose the need for handling the switch without winding it up, which was inconvenient especially with regard to transporting, storing, and the like.

An example of another conventional continuous-length switch will be explained with reference to FIG. 43 and FIG. 44.

A conventional continuous-length switch as shown in FIG. 43 and FIG. 44 comprises a lower electrode plate 321 made of a continuous-length plate-like conductive material; an upper electrode plate 322 made of a continuous-length plate-like conductive material; and a jacket 324 made of a continuous-length insulating material which has a pair of symmetrical protrusions 324*a* and 324*b* on the inner walls of both sides thereof to form a space portion 323 between the lower electrode plate 321 and the upper electrode plate 322, and is open on its bottom side; two strings 325, for example, which are wound around the circumference of the jacket 324 in a crossed configuration to integrate the lower electrode plate 321 with the upper electrode plate 322; and a continuous-length adhesive tape 326 which is bonded to the strings 325 on the bottom side of the lower electrode plate 321 along the longitudinal direction of the lower electrode plate 321.

In other words, the upper electrode plate 322 is held between the pair of protrusions 324*a* and 324*b* inside the jacket 324 and an inner wall ceiling 324*c* of the jacket 324; and the lower electrode plate 321 is attached to the lower surfaces of the pair of protrusions 324*a* and 324*b*. Then, the process of cross-winding the two strings 325 is carried out to integrate the lower electrode plate 321 with the upper electrode plate 322.

At the middle of the top of the jacket 324, a protrusion 324*d* is provided, and by pressing this protrusion 324*d* with a foot or the like, the upper electrode plate 322 is deformed through the protrusion 324*d* in the region of the space portion 323, resulting in a switching operation being performed by the lower electrode plate 321 and the upper electrode plate 322.

As stated above, conventional continuous-length switches are easy to be short-circuited, thereby presenting problems of safety and reliability, and requiring cumbersome secondary working. In addition, they have presented a problem in that power requirement is high.

The present invention has been developed in consideration of the above situation, being intended to offer a continuous-length switch which is excellent in safety and reliability, eliminates the need for a cumbersome secondary working, allows improvement of the operational efficiency during manufacturing, and can minimize the power requirement.

As stated above, conventional continuous-length switches are easy to be short-circuited, thereby presenting problems of safety and reliability. And to prevent the electrode plates from being buckled during transporting, storing and the like, they were required to have been handled in a cumbersome and inconvenient way.

The present invention has been developed in consideration of the above situation, being intended to offer a continuous-length switch which is difficult to be short-circuited and, is excellent in safety and reliability. Also, if winding up or the like of the switch is carried out, buckling and the like are difficult to be caused. Therefore, the restriction in handling the switch can be loosened, and winding the switch around a drum for transportation and storage is allowed, thereby resulting in the operability of the switch being improved and the space requirement therefor being reduced.

With the conventional continuous-length switch as stated above, a continuous-length jacket 324 is used to form a space portion 323 between the lower electrode plate 321 and the upper electrode plate 322. Then, the process of cross-winding the two strings 325 is carried out to integrate the lower electrode plate 321 with the upper electrode plate 322. Therefore, a problem in that the manufacturing process is cumbersome, which results in the cost of the continuous-length switch being increased, has been presented.

The present invention has been developed in consideration of the above situation, being intended to offer a continuous-length switch which is excellent in durability. A manufacturing method for the switch is simple, and therefore, the manufacturing cost can be reduced and a continuous-length switch excellent in durability can be obtained.

According to one aspect of the invention, the continuous-length switch is a continuous-length switch including a pair of continuous-length electrode plates that are contacted with or separated from each other for carrying out a switching operation, wherein at least one of the pair of electrode plates has a linear conductive portion continuing in a longitudinal direction thereof.

Because, at least one electrode plate has a linear conductive portion continuing in the longitudinal direction, a problem of the conductor getting beneath the insulator can be avoided. Also, if a tensile force is applied to the lead wire for connection to another device, the electrode plate will not be deformed or displaced, resulting in the safety and the reliability of the switch being improved. In addition, the lead wire can easily be drawn out to be worked, which results in operation man-hours being reduced.

Further, because a linear conductive portion is provided, the line length of the electrode plate is shortened, resulting in the electrode resistance thereof being decreased. And, when a four-wire type disconnection detection is carried out, the electric power requirement can be minimized.

The continuous-length switch according to a second aspect of the invention is a continuous-length switch according to the first aspect, wherein at least one of the pair of electrode plates has a number of protrusions which are formed at fixed intervals, extending from the linear conductive portion continuing in the longitudinal direction toward a contact surface of the other electrode plate, and also along a direction crossing the linear conductive portion.

Because the continuous-length switch is configured so that at least one of the pair of electrode plates has a number of protrusions which are formed at fixed intervals, extending from the linear conductive portion along the direction crossing the linear conductive portion, the mechanical strength of this electrode plate with respect to an external force is lowered, which allows a highly sensitive switch to be realized. Because the mechanical strength of the electrode plate can be lowered, a strong material can be adopted for use as the electrode plate.

The continuous-length switch according to a third aspect of the invention is a continuous-length switch according to the first aspect, wherein at least one of the pair of electrode plates has a number of comb-tooth-like protrusions which are formed on the linear conductive portion continuing in the longitudinal direction.

Because the continuous-length switch is configured so that at least one of the pair of electrode plates has a number of comb-tooth-like protrusions which are formed on the linear conductive portion continuing in the longitudinal direction, the mechanical strength of this electrode plate with respect to an external force is lowered, which allows a highly sensitive switch to be realized. Because the mechanical strength of the electrode plate can be lowered, a strong material can be adopted for use as the electrode.

The continuous-length switch according to a fourth aspect of the invention is a continuous-length switch including a pair of continuous-length electrode plates that are contacted with or separated from each other for carrying out a switching operation, wherein at least one of the pair of electrode plates has a linear conductive portion at both side areas thereof along the longitudinal direction of this electrode plate. Between both of these linear conductive portions, non-conductive portions having an optional geometry are formed.

Because at least one of the pair of electrode plates has a linear conductive portion at both side areas along the longitudinal direction, and because between both of these linear conductive portions non-conductive portions having an optional geometry are formed, a problem of the conductor getting beneath the insulator, as is encountered with conventional continuous-length switches, can be avoided. Also, if a tensile force is applied to the lead wire for connection to another device, this electrode plate will not be deformed or displaced, resulting in the safety and reliability of the switch being improved. In addition, the lead wire can easily be drawn out to be worked, which results in operation man-hours being reduced.

Further, because a linear conductive portion is provided at both side areas, and because between these linear conductive portions non-conductive portions having an optional geometry are formed, the conductive distance is smaller, resulting in the electrical resistance being reduced. And, even in the case where the four-wire type disconnection detection is performed, the power requirement can be minimized.

The continuous-length switch according to a fifth aspect of the invention is a continuous-length switch according to the fourth aspect, wherein the non-conductive portions are selected from circular holes, oval holes, rhombic holes, polygonal holes, lattice holes, and nearly step-like holes.

Because a continuous-length switch with which the geometry of the non-conductive portions can be specified to be any one of various geometries, such as circular holes, oval holes, rhombic holes, polygonal holes, lattice holes, and nearly step-like holes, an optional geometry of the non-conductive portions can be selected to reduce the conductive distance, decrease the electrical resistance, and minimize the power requirement even in the case where the four-wire type disconnection detection is performed.

The continuous-length switch according to a sixth aspect of the invention is a continuous-length switch according to the fourth aspect, wherein the non-conductive portions are a number of variation holes which are defined by a number of bridges interconnecting the linear conductive portions. The bridges have a bulging portion at a middle thereof and are spaced from adjacent bridges.

According to the sixth aspect, as is the case with the invention as set forth in the fifth aspect, a continuous-length switch is provided for which the conductive distance can be reduced, the electrical resistance can be decreased, and the power requirement can be minimized even in the case where the four-wire type disconnection detection is performed.

The continuous-length switch according to a seventh aspect of the invention is a continuous-length switch in which a pair of continuous-length electrode plates are contacted with or separated from each other for carrying out switching operation, wherein at least one of the pair of electrode plates has linear conductive portions formed at both side areas thereof along the longitudinal direction of this electrode plate, non-conductive portions which are formed between the linear conductive portions and comprise holes having an optional geometry of various polygonal geometries or various geometries other than the polygonal geometries, and protrusions formed at the locations of the linear conductive portions outside of each of the holes.

Because at least one of the pair of electrode plates is configured so that linear conductive portions are formed at both side areas along the longitudinal direction, because non-conductive portions comprising holes having an optional geometry of various geometries are formed between the linear conductive portions and because protrusions are formed at the locations of the linear conductive portions outside of each of the holes, the linear conductive portions allow the avoidance of a problem of the conductor getting beneath the insulator, as is encountered with conventional continuous-length switches, to prevent occurrence of short-circuiting. Also provided is excellent safety and reliability, and the difference between the inside and outside diameters of the continuous-length switch which is generated during bending can be accommodated by the protrusions, which allows the continuous-length switch to be easily wound around a drum or the like with generation of buckling of the electrode plate being suppressed. Therefore, improvement of operability of the switch and reduction of a space requirement can be achieved.

The continuous-length switch according to an eighth aspect of the invention is a continuous-length switch including a pair of continuous-length electrode plates that are contacted with or separated from each other for carrying out a switching operation, wherein at least one of the pair of electrode plates has linear conductive portions formed at both side areas along the longitudinal direction of this electrode plate, non-conductive portions which are formed between the linear conductive portions which comprise holes having an optional geometry of various polygonal geometries and various geometries other than the polygonal geometries, and protrusions which have a sectional geometry selected from various polygonal geometries and various geometries other than the polygonal geometries, including triangular, trapezoidal, circular, semi-circular, and oval geometries, being formed at the locations of the linear conductive portions outside of each of the holes.

According to the eighth aspect, at least one of the pair of electrode plates is configured so that linear conductive portions are formed at both side areas along the longitudinal direction, non-conductive portions comprising holes having an optional geometry of the various geometries are formed between both of the linear conductive portions, and protrusions which have a sectional geometry selected from the various polygonal geometries and various geometries other than the polygonal geometries, including triangular, trapezoidal, circular, semi-circular, and oval geometries are formed at the locations of the linear conductive portions outside of each of the holes.

Therefore, as is the case with the invention according to die seventh embodiment, the linear conductive portions allow the avoidance of a problem of the conductor getting beneath the insulator, as is encountered with conventional continuous-length switches, to prevent occurrence of short-circuiting. Also, provided is excellent safety and reliability, and the difference between the inside and outside diameters of the continuous-length switch itself which is generated during bending can be accommodated by the protrusions having any one of the above-mentioned geometries, which allows the continuous-length switch to be easily wound around a drum or the like with generation of buckling of the electrode plate being suppressed. Therefore, improvement of operability of the switch and reduction of a space requirement can be achieved.

The continuous-length switch according to a ninth aspect of the invention is a continuous-length switch comprising: a lower electrode plate made of a continuous-length plate-like conductive material; a continuous-length insulating material which covers the circumference of this lower electrode plate except at an opening portion of the insulating material; an upper electrode plate made of a continuous-length plate-like conductive material which is placed on the opening portion; and a jacket made of a continuous-length insulating material which covers the circumferences of the insulating material and the upper electrode plate, wherein the jacket has a protrusion at its top.

Because the lower electrode plate is covered with a continuous-length insulating material except for at the opening portion, and because the circumferences of the insulating material and the upper electrode plate are covered with a jacket which is made of a continuous-length insulating material that has a protrusion at its top, the lower electrode plate and the tipper electrode plate can be firmly held in place while the opening portion provides a space region for contact that is formed between the lower electrode plate and the upper electrode plate, whereby a continuous-length switch having excellent durability can be provided.

A method for manufacturing a continuous-length switch comprises a process in which the circumference of a lower electrode plate that is made of a continuous-length plate-like conductive material is covered with an insulating material of a uniform thickness by extrusion; a process in which two grooves are formed parallel to each other in the insulating material above the lower electrode plate along the longitudinal direction of the lower electrode plate; a process in which the insulating material on the upper side of the lower electrode plate is peeled off in the area between the two grooves along the longitudinal direction of the lower electrode plate to form an opening portion on the upper side of the lower electrode plate; a process in which an upper electrode plate made of a continuous-length plate-like conductive material is placed on the insulating material over the opening portion; and a process in which a jacket having a protrusion at a middle of the top thereof, which extends along the longitudinal direction, is formed over the entire circumferences of the insulating material and the upper electrode plate by extrusion-forming an insulating material.

Because the circumference of the lower electrode plate made of a continuous-length plate-like conductive material is covered with an insulating material of a uniform thickness by extrusion; because two grooves are formed in the insulating material; because the insulating material is peeled off in the area between the two grooves along the longitudinal direction of the lower electrode plate to form an opening portion on the upper side of the lower electrode plate; because an upper electrode plate made of a continuous-length plate-like conductive material is placed on the insulating material over the opening portion; and because a jacket having a protrusion at the middle of the top thereof is formed over the entire circumferences of the insulating material and the upper electrode plate by extrusion-forming an insulating material to provide a continuous-length switch, the manufacturing process can be simplified as compared to that for the conventional continuous-length switch, while the manufacturing cost is reduced. Thus, a manufacturing method which allows for the obtaining of a continuous-length switch having excellent durability can be realized.

SUMMARY OF THE INVENTION

The present invention can offer a continuous-length switch which is excellent in safety and reliability, eliminates the need for a cumbersome secondary working, allows improvement of the operational efficiency during manufacturing, and can minimize a power requirement.

The present invention can offer a continuous-length switch which is difficult to be short-circuited and is excellent in safety and reliability. Also, if winding up or the like of the switch is carried out, buckling and the like of the switch are difficult to be caused. Therefore, the restriction in handling of the switch can be loosened, and winding the switch around a drum for transportation and storage is allowed, thereby resulting in the operability of the switch being improved and a space requirement being reduced.

The present invention can offer a continuous-length switch which is excellent in durability, and will not fail after a long period of use.

DETAILED DESCRIPTION OF THE PREFERRED EMBODIMENTS

Hereinbelow, embodiments of the present inventions will be described in detail.

Embodiment 1

Figure 1:
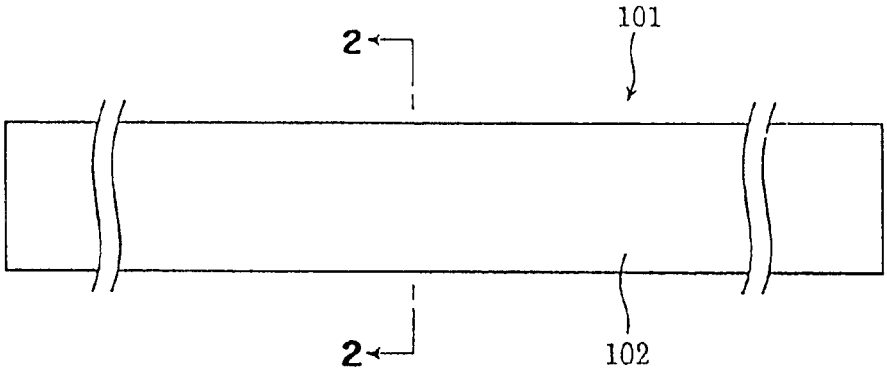
FIG. 1 is a plan view of a continuous-length switch according to a first embodiment of the present invention, with parts omitted for clarity.
Figure 2:
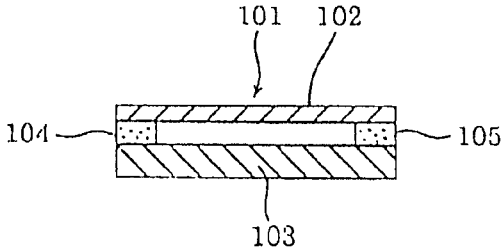
FIG. 2 is a sectional view taken along the line 2—2 in FIG. 1.

FIG. 1 and FIG. 2 show a continuous-length switch 101 according to a first embodiment of the present invention, in which a continuous-length and elastic upper electrode plate 102 and lower electrode plate 103 are disposed. The plates 102 and 103 oppose each other and sandwich a pair of continuous-length insulators 104 and 105 that extend along a longitudinal direction of the plates. A switching function is provided when the action of an external force F applied by an operator, a subject, or the like causes the upper electrode plate 102 to be deflected and contacted with the lower electrode plate 103.

Next, with reference to FIG. 3 to FIG. 13, various examples of the geometry of the upper electrode plate 102 will be described.

Figure 3:
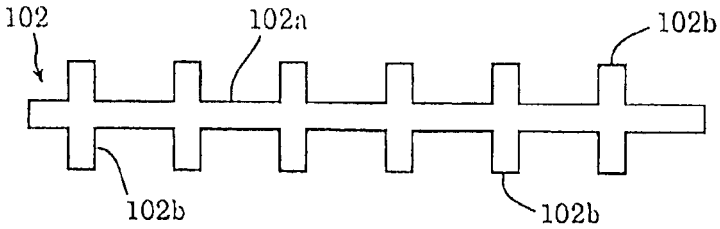
FIG. 3 is a plan view of an upper electrode plate provided with a number of protrusions according to the first embodiment.

With the geometry of the upper electrode plate 102 as shown in FIG. 3, a number of protrusions 102*b* are formed at fixed intervals, which extend from a linear conductive portion 102*a*, that continues in the longitudinal direction, toward the contact surface of the lower electrode plate 103, and also extend along a direction crossing the linear conductive portion 102*a*.

In this case, the lower electrode plate 103 may have a geometry corresponding to that of the upper electrode plate 102.

With the continuous-length switch 101 which uses such an upper electrode plate 102, a problem of the conductor getting beneath the insulator, as is encountered with conventional continuous-length switches, can be avoided. And, if a tensile force is applied to the lead wire for connection to another device, the upper electrode plate 102 will not be deformed or displaced, resulting in safety and reliability of the switch being improved. In addition, the lead wire can easily be drawn out to be worked, which results in operation man-hours being reduced.

Further, because the linear conductive portion 102*a* is provided, the length of the current flowing line is shortened, the electrical resistance is lowered, and, where the four-wire type disconnection detection is performed, the power requirement can be minimized.

The addition of the protrusions 102*b* lowers the mechanical strength of the upper electrode plate 102 with respect to the external force, which allows a highly sensitive switch to be realized, and because the mechanical strength of the electrode plate can be lowered, a strong material can be adopted for use as the electrode. Additionally, if the lower electrode plate 103 is provided with a geometry corresponding to that of the upper electrode plate 102, a switch-on operation can be reliably accomplished.

Figure 4:
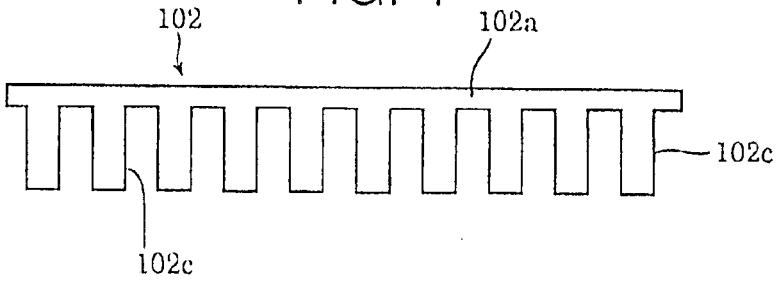
FIG. 4 is a plan view of an upper electrode plate provided with a number of comb-tooth-like protrusions according to the first embodiment.

With the geometry of the upper electrode plate 102 as shown in FIG. 4, a number of comb-tooth-like protrusions 102*c* are formed at fixed intervals on the linear conductive portion 102*a* continuing in the longitudinal direction.

In this case, the lower electrode plate 103 may have a geometry corresponding to that of the upper electrode plate 102.

With the continuous-length switch 101 which uses such an upper electrode plate 102, the safety and the reliability of the switch can be improved, the operation man-hours can be reduced, and the power requirement can be minimized as is the case with the geometry as shown in FIG. 3.

Further, the mechanical strength of the upper electrode plate 102 with respect to the external force can be lowered, which allows for a highly sensitive switch to be realized, and because the mechanical strength of the electrode plate can be lowered, a strong material can be adopted for use as the electrode, and a switch-on operation can be reliably accomplished.

Embodiment 2

Next, with reference to FIG. 5 to FIG. 13, the continuous-length switch according to a second embodiment of the present invention will be described.

The basic configuration of the continuous-length switch according to the second embodiment is the same as that of the continuous-length switch according to the first embodiment, except that, as shown in FIG. 5 to FIG. 13, an upper electrode plate 120 in the continuous-length switch has a linear conductive portion 121*a*, 121*b* at both side areas along the longitudinal direction of the electrode plate, and between the linear conductive portions 121*a* and 121*b*, non-conductive portions 130 having any one of the various geometries as stated below are formed.

Figure 5:
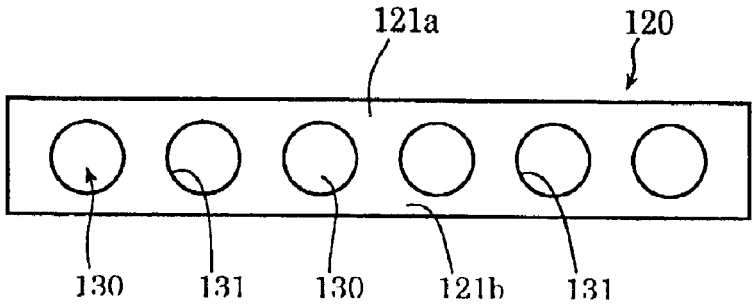
FIG. 5 is a plan view of an upper electrode plate provided with circular holes according to a second embodiment.
Figure 6:
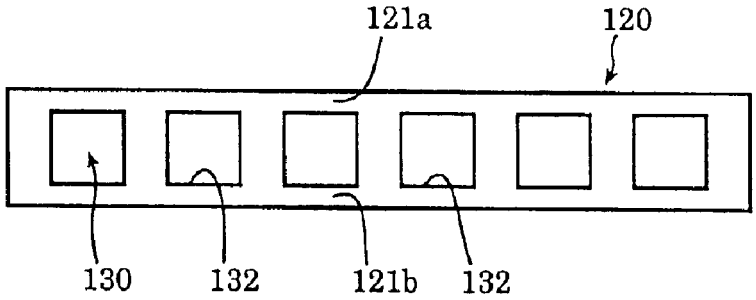
FIG. 6 is a plan view of an upper electrode plate provided with square holes according to the second embodiment.
Figure 7:
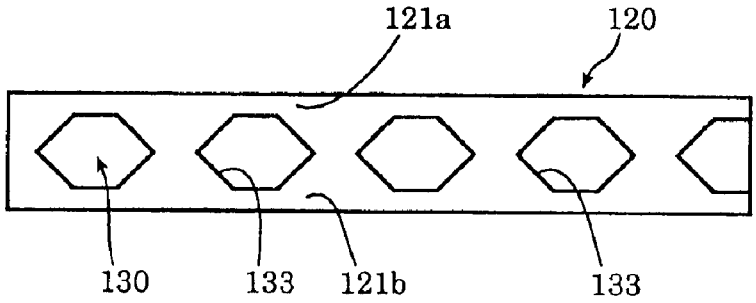
FIG. 7 is a plan view of an upper electrode plate provided with hexagonal holes according to the second embodiment.
Figure 8:
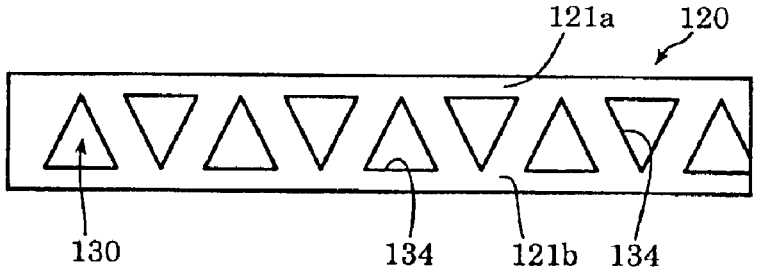
FIG. 8 is a plan view of an upper electrode plate provided with triangular holes according to the second embodiment.
Figure 9:
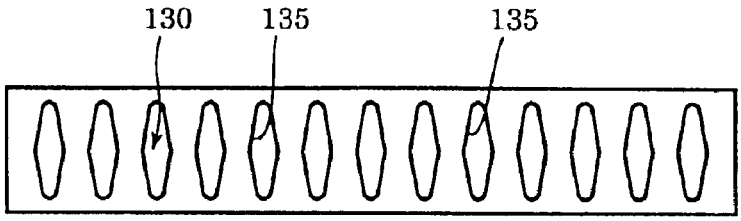
FIG. 9 is a plan view of an upper electrode plate provided with rhombic holes according to the second embodiment.
Figure 10:
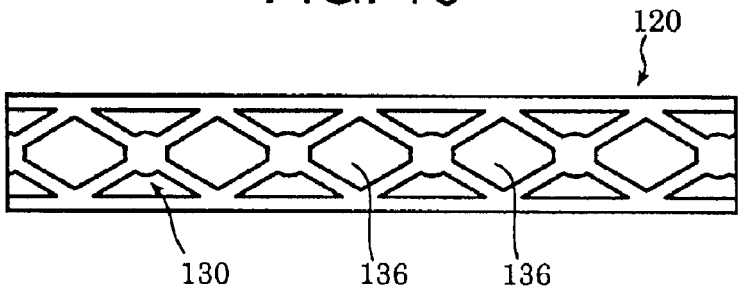
FIG. 10 is a plan view of an upper electrode plate provided with diagonal lattice holes according to the second embodiment.
Figure 11:
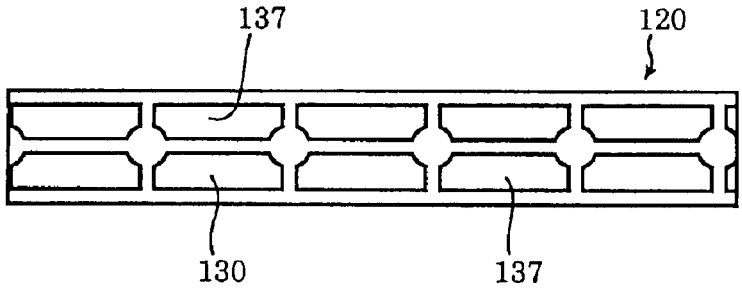
FIG. 11 is a plan view of an upper electrode plate provided with rectangular lattice holes according to the second embodiment.
Figure 12:
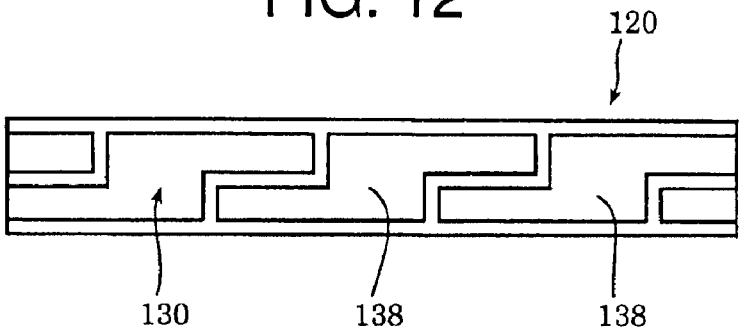
FIG. 12 is a plan view of an upper electrode plate provided with nearly step-like variation holes according to the second embodiment.

FIG. 5 shows an example in which the upper electrode plate 120 is provided with a number of circular holes 131 as the non-conductive portions 130; FIG. 6 shows an example in which the upper electrode plate 120 is provided with a number of square holes 132 as the non-conductive portions 130; FIG. 7 shows an example in which the upper electrode plate 120 is provided with a number of hexagonal holes 133 as the non-conductive portions 130; FIG. 8 shows an example in which the upper electrode plate 120 is provided with a number of triangular holes 134 as the non-conductive portions 130; FIG. 9 shows an example in which the upper electrode plate 120 is provided with a number of rhombic holes 135 as the non-conductive portions 130; FIG. 10 shows an example in which the upper electrode plate 120 is provided with a number of diagonal lattice holes 136 as the non-conductive portions 130; FIG. 11 shows an example in which the upper electrode plate 120 is provided with a number of rectangular lattice holes 137 as the non-conductive portions 130; and FIG. 12 shows an example in which the upper electrode plate 120 is provided with a number of nearly step-like variation holes 138 as the non-conductive portions 130.

Figure 13:
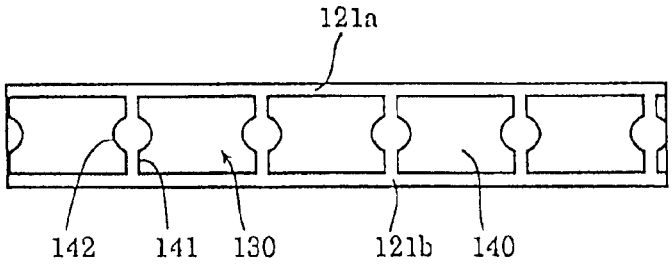
FIG. 13 is a plan view of an upper electrode plate provided with variation holes according to the second embodiment.
Figure 14:
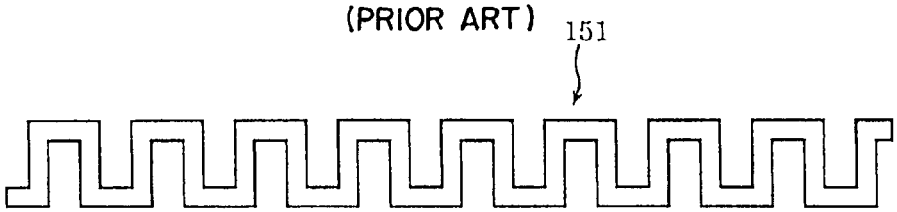
FIG. 14 (PRIOR ART)
FIG. 14 is a plan view of an example of an upper electrode plate of a conventional continuous-length switch.
Figure 15:
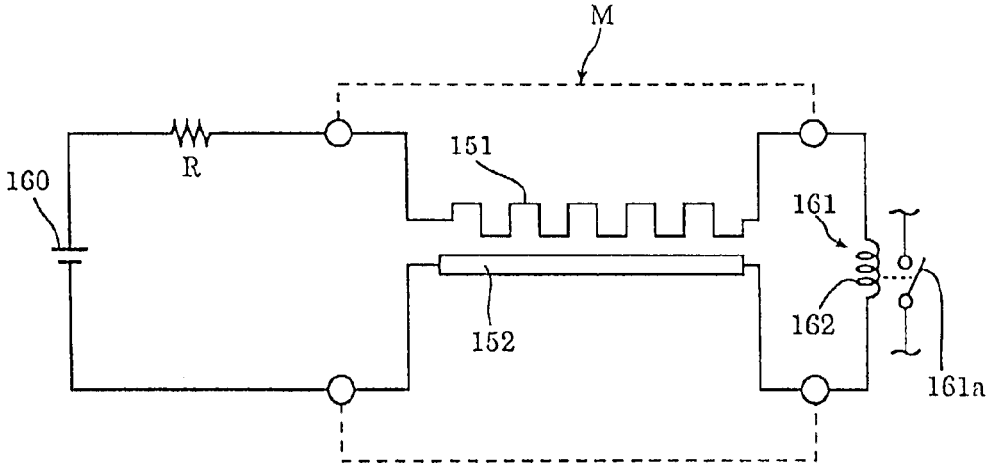
FIG. 15 (PRIOR ART)
FIG. 15 is a four-wire type disconnection detection circuit for a conventional continuous-length switch.

Further, FIG. 13 shows an example in which the upper electrode plate 120 is provided with a number of spaced variation holes 140 as the non-conductive portions 130, which are defined by a number of bridges 141 that interconnect the linear conductive portions 121*a* and 121*b*, which bridges 141 each have a bulging portion 142 at a middle thereof.

As shown in FIG. 5 to FIG. 13, the upper electrode plate 120 is formed so as to have the linear conductive portions 121*a* and 121*b* at both side areas along the longitudinal direction, and between these conductive portions the non-conductive portions having any one of the various geometries. Such an upper electrode plate 120 is used to configure the continuous-length switch 101.

The lower electrode plate 103 may, of course, have a geometry corresponding to that of the upper electrode plate 102 as shown in FIG. 5 to FIG. 13.

As the non-conductive portions 130, a group of oval holes can be adopted besides the above-mentioned holes.

With the continuous-length switch according to the second embodiment of the present invention, the linear conductive portions 121*a* and 121*b* at both side areas allow for the avoidance of a problem in which the conductor gets beneath the insulator, as is encountered with conventional continuous-length switches. Also, if a tensile force is applied to the lead wire for connection to another device, the upper electrode plate 120 will not be deformed or displaced, resulting in safety and reliability of the switch being improved. In addition, the lead wire can easily be drawn out to be worked, which results in operation man-hours being reduced.

Further, a continuous-length switch in which the linear conductive portions 121*a*, 121*b* are provided at both side areas, and between these conductive portions, the non-conductive portions 130 having an optional geometry are formed, results in the conductive distance being smaller, which correspondingly results in the electrical resistance being reduced. And, even in the case where the four-wire type disconnection detection is performed, the power requirement can be minimized.

Embodiment 3

Figure 16:
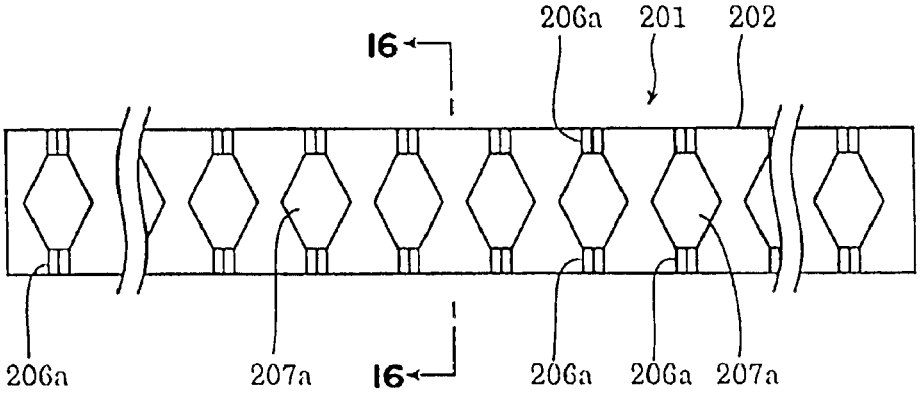
FIG. 16 is a diagramatic plan view of a continuous-length switch according to a third embodiment of the present invention.
Figure 17:
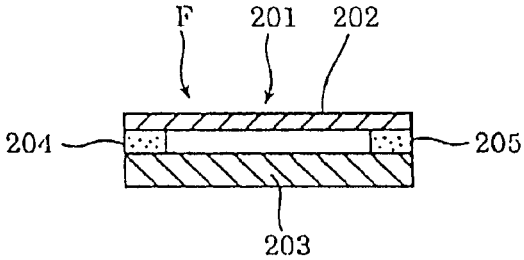
FIG. 17 is a sectional view taken along the line 16—16 in FIG. 16.
Figure 18:
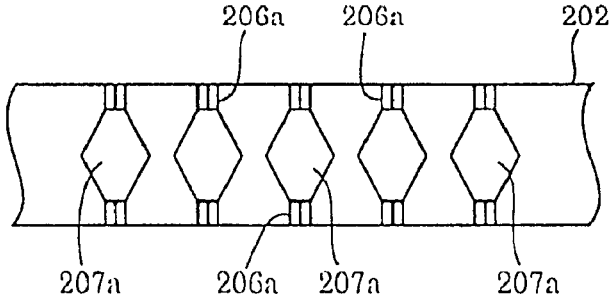
FIG. 18 is a plan view of a first example of a geometry of holes as non-conductive portions of the continuous-length switch according to the third embodiment of the present invention.

FIG. 16 and FIG. 17 show a continuous-length switch 201 according to a third embodiment of the present invention, in which a continuous-length and elastic upper electrode plate 202 and lower electrode plate 203 are disposed. The plates 202 and 203 oppose each other and sandwich a pair of continuous-length insulators 204 and 205 that extend along a longitudinal direction of the plates. A switching function is provided when the action of an external force F applied by an operator, a subject, or the like causes the upper electrode plate 202 to be deflected and contacted with the lower electrode plate 203.

FIG. 16 is a plan view illustrating one example of a geometry of the upper electrode plate 202. The upper electrode plate 202 is provided with a number of, for example, hexagonal holes 207*a* at fixed intervals as non-conductive portions, and at both upper and lower sides of each hexagonal hole 207*a* in FIG. 16, a linear conductive portion along the longitudinal direction of the upper electrode plate 202 is formed.

Figure 22:
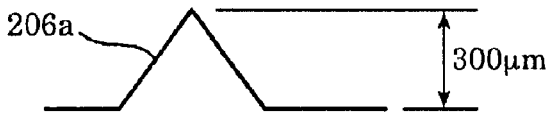
FIG. 22 is an enlarged sectional view of a first example of a protrusion of the continuous-length switch according to the third embodiment of the present invention.

In addition, in the linear conductive portion provided at both upper and lower sides of each hexagonal hole 207*a* in FIG. 16, a number of protrusions 206*a* having a triangular section, for example, are provided as shown in FIG. 22.

The height of each protrusion 206*a* from the top of the upper electrode plate 202 to the protrusion summit is approximately 300 $\mu$m, for example, in the present embodiment.

Figure 19:
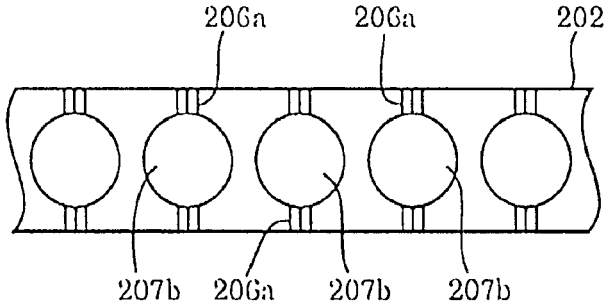
FIG. 19 is a plan view of a second example of a geometry of the holes as non-conductive portions of the continuous-length switch according to the third embodiment of the present invention.
Figure 20:
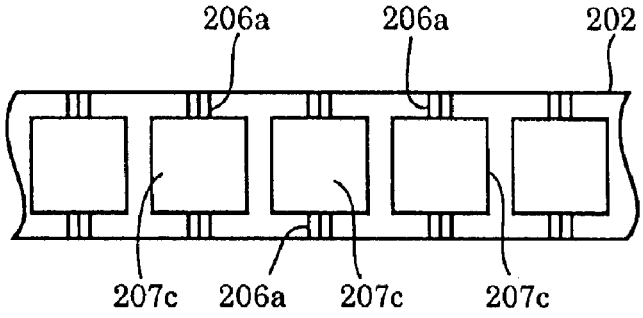
FIG. 20 is a plan view of a third example of a geometry of the holes as non-conductive portions of the continuous-length switch according to the third embodiment of the present invention.
Figure 21:
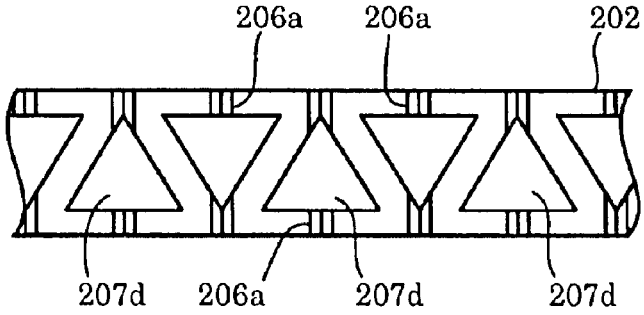
FIG. 21 is a plan view of a fourth example of a geometry of the holes as non-conductive portions of the continuous-length switch according to the third embodiment of the present invention.

With the present embodiment, the geometry of the hole as a non-conductive portion is not limited or defined. Besides the geometry of the hexagonal hole 207*a* as a non-conductive portion as shown in FIG. 16, holes formed as non-conductive portions may, of course, have a wide variety of geometries as shown in FIG. 19, FIG. 20, and FIG. 21, for example, which will be later described.

Further, with the present invention, the sectional geometry of the above-mentioned protrusion is not limited or defined. Besides the sectional geometry of the protrusions 206*a* as shown in FIG. 22, protrusions formed may, of course, have a wide variety of sectional geometries as shown in FIG. 24, FIG. 25, FIG. 26, FIG. 27, FIG. 28, and FIG. 29, for example, which will be later described.

With the continuous-length switch 201 according to the present embodiment, which uses such an upper electrode plate 202, a problem of the conductor getting beneath the insulator, as is encountered with conventional continuous-length switches, can be avoided.

Figure 30:
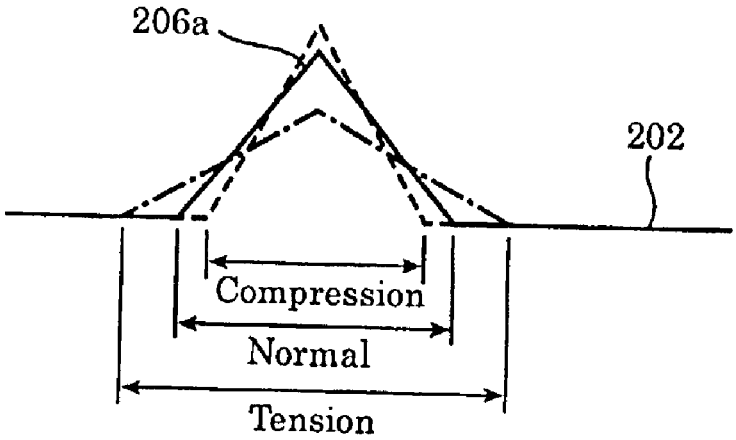
FIG. 30 is an explanatory drawing illustrating the expansion and contraction of the protrusion of the continuous-length switch according to the third embodiment of the present invention, and also is an explanatory drawing illustrating the tension and compression states of the protrusion of the continuous-length switch according to the third embodiment of the present invention.

In addition, when the continuous-length switch 201 is bent to be wound around a drum, for example, the protrusions 206*a* are deformed as shown with a dotted line in FIG. 30, when a compression force is applied to the switch, and is deformed as shown with a dot-dash line in FIG. 30 when a tensile force is applied to the switch, so that, in either case, the protrusions 206*a* can accommodate the difference between the inside and outside diameters caused by the bending of the continuous-length switch 201.

Figure 31:
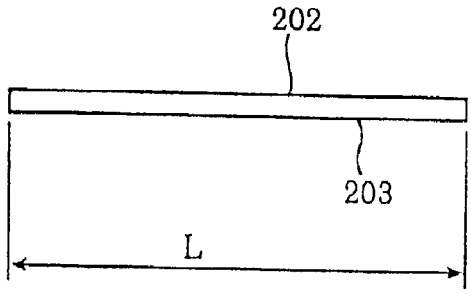
FIG. 31 is an explanatory drawing illustrating the length in the spread state of the continuous-length switch according to the third embodiment of the present invention.
Figure 32:
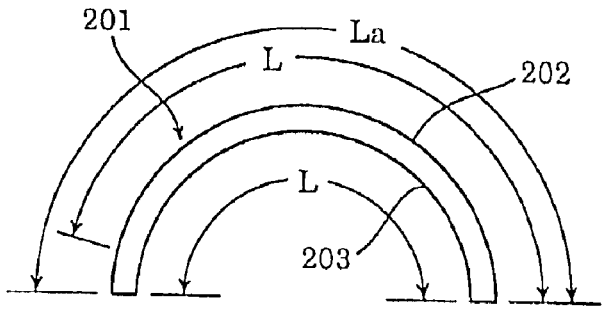
FIG. 32 is an explanatory drawing illustrating the length in the wound-up state of the continuous-length switch according to the third embodiment of the present invention.
Figure 33:
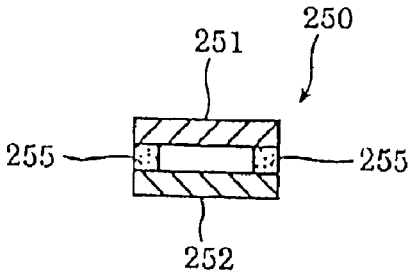
FIG. 33 (PRIOR ART)
FIG. 33 is a sectional view of a conventional continuous-length switch.
Figure 34:
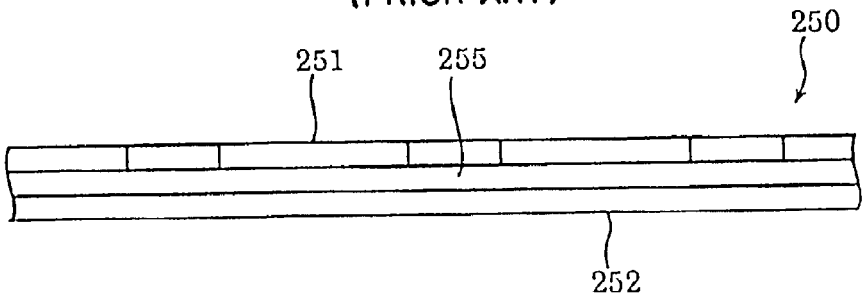
FIG. 34 (PRIOR ART)
FIG. 34 is a diagramatic side view of a conventional continuous-length switch.
Figure 35:
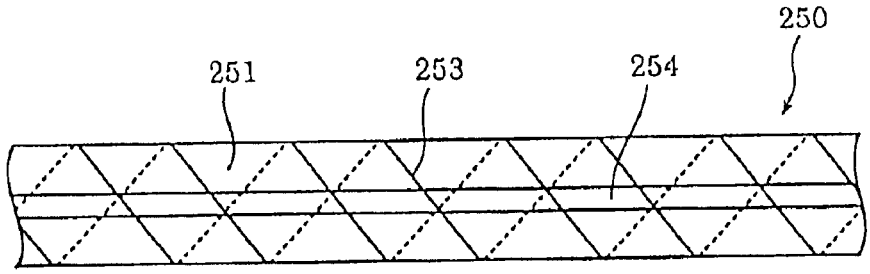
FIG. 35 (PRIOR ART)
FIG. 35 is a diagramatic plan view of a conventional continuous-length switch.
Figure 36:
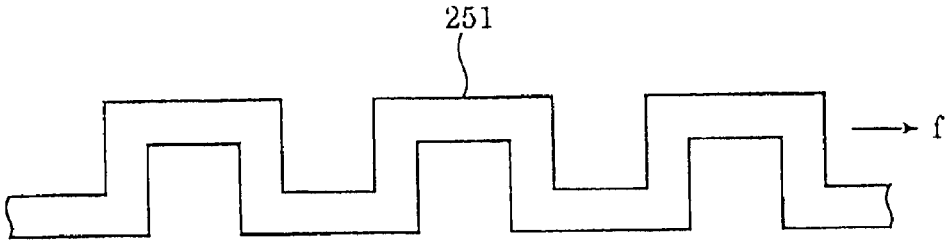
FIG. 36 (PRIOR ART)
FIG. 36 is a plan view of an upper electrode plate of a conventional continuous-length switch.

In other words, if it is assumed that the length of the continuous-length switch 201 in the spread state (the normal state) is "L" as illustrated in FIG. 31, bending the continuous-length switch 201 circularly to wind it around a drum or the like as shown in FIG. 32 stretches the continuous-length switch 201 on the upper electrode plate 202 side and contracts it on the lower electrode plate 203 side, resulting in the dimension on the upper electrode plate 202 side being increased to the length La, which is longer than the length L in the spread state, but the difference in dimension, (La−L), at this time can be accommodated with the stretch of the protrusions 206*a*.

Therefore, the difference between the inside and outside diameters of the continuous-length switch 201 itself, which is generated during the bending, can be accommodated by the protrusions 206*a* which allow the continuous-length switch 201 to be easily wound around a drum or the like with generation of buckling of the upper electrode plate 202 being suppressed, and therefore improvement of operability of the switch and reduction of space requirement can be achieved.

FIG. 19, FIG. 20, and FIG. 21 show variations of the above-mentioned non-conductive portion, i.e., a circular hole 207*b*, a square hole 207*c*, and a triangular hole 207*d*, respectively, which are variations of the above-mentioned non-conductive portion, i.e. hexagonal hole 207*a*.

The non-conductive portions configured so as to have geometries as shown in FIG. 19, FIG. 20, and FIG. 21 can provide the same function and effect as those of the hexagonal hole 207*a* as the non-conductive portion. In any event, with the present invention, the geometry of the hole as the non-conductive portion is not limited or necessarily defined as stated above.

Figure 23:
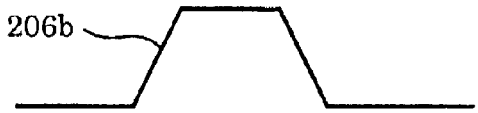
FIG. 23 is an enlarged sectional view of a second example of the protrusion of the continuous-length switch according to the third embodiment of the present invention.
Figure 24:
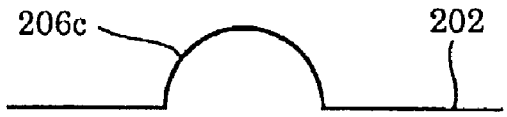
FIG. 24 is an enlarged sectional view of a third example of the protrusion of the continuous-length switch according to the third embodiment of the present invention.
Figure 25:
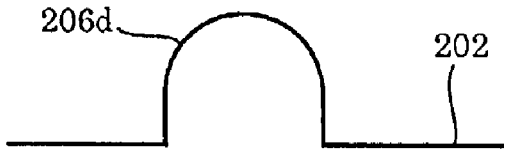
FIG. 25 is an enlarged sectional view of a fourth example of the protrusion of the continuous-length switch according to the third embodiment of the present invention.
Figure 26:
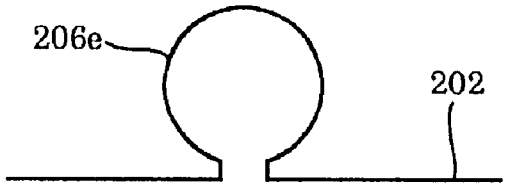
FIG. 26 is an enlarged sectional view of a fifth example of the protrusion of the continuous-length switch according to the third embodiment of the present invention.
Figure 27:
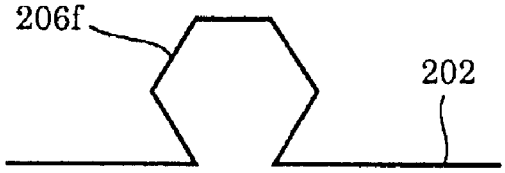
FIG. 27 is an enlarged sectional view of a sixth example of the protrusion of the continuous-length switch according to the third embodiment of the present invention.
Figure 28:
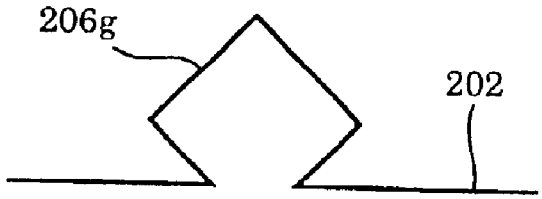
FIG. 28 is an enlarged sectional view of a seventh example of the protrusion of the continuous-length switch according to the third embodiment of the present invention.
Figure 29:
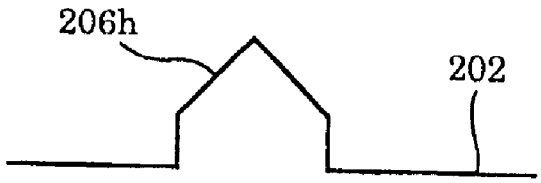
FIG. 29 is an enlarged sectional view of an eighth example of the protrusion of the continuous-length switch according to the third embodiment of the present invention.

FIG. 23, FIG. 24, and FIG. 25 show variations of the above-mentioned protrusion 206*a*, i.e., a protrusion 206*b* having a trapezoid section, a protrusion 206*c* having a semicircular section, and a protrusion 206*d* having a semi-oval section, respectively.

The protrusions 206*b* to 206*d* as shown in FIG. 23, FIG. 24, and FIG. 25 are formed in the same way as the above-mentioned protrusion 206*a*, and if upper electrode plates 202 which adopt these protrusions 206*b* to 206*d* are used, the same function and effect as stated above can be provided.

FIG. 26, FIG. 27, FIG. 28, and FIG. 29 show other variations of the above-mentioned protrusion 206*a*, i.e., a protrusion 206*e* having a circular section (FIG. 26), and protrusions 206*f* to 206*h* (FIG. 27 to FIG. 29) having a variety of polygonal sections, respectively.

The protrusions 206*e* to 206*h* as shown in FIG. 26, FIG. 27, FIG. 28, and FIG. 29 are formed in the same way as the above-mentioned protrusion 206*a*, and if upper electrode plates 202 which adopt these protrusions 206*e* to 206*h* are used, the same function and effect as stated above can be provided.

In any event, with the present invention, the geometry of the protrusion is not limited or necessarily defined as stated above.

Embodiment 4

Figure 37:
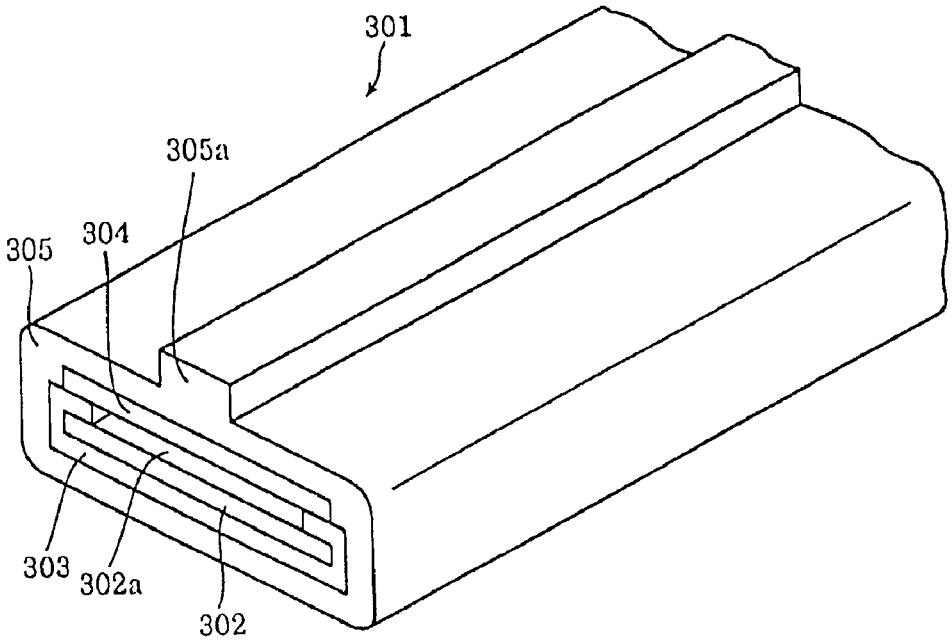
FIG. 37 is a perspective side view of a continuous-length switch according to a fourth embodiment of the present invention.

FIG. 37 shows a continuous-length switch 301 according to an embodiment of the present invention, and this continuous-length switch 301 comprises a lower electrode plate 302 made of a continuous-length plate-like conductive material; a continuous-length insulating material 303 which covers the circumference of this lower electrode plate 302 except for an opening portion 302*a*; an upper electrode plate 304 made of a continuous-length plate-like conductive material which is placed on the opening portion 302*a*; and a jacket made of a continuous-length insulating material which covers the circumferences of the insulating material 303 and the upper electrode plate 304, and has a protrusion 305*a* at its top.

Hereinbelow the method for manufacturing the continuous-length switch 301 according to the present embodiment will be described.

Figure 38:
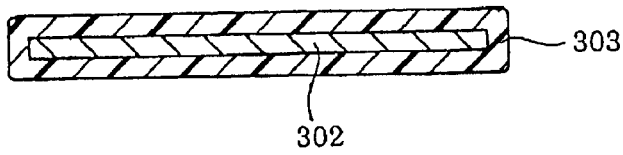
FIG. 38 is a sectional view illustrating a process of manufacturing the continuous-length switch according to the fourth embodiment of the present invention.

First, as shown in FIG. 38, the circumference of the lower electrode plate 302 made of a continuous-length plate-like conductive material is covered with the insulating material 303 of a uniform thickness by extrusion.

Figure 39:
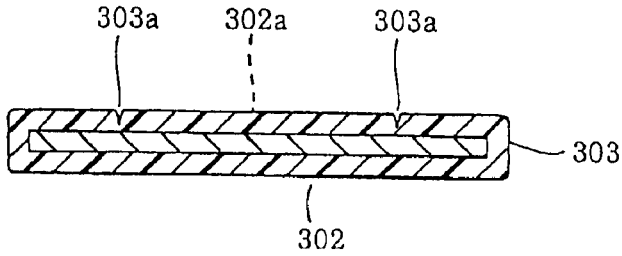
FIG. 39 is a sectional view illustrating a process of manufacturing the continuous-length switch according to the fourth embodiment of the present invention.

Then, as shown in FIG. 39, to form the opening portion 302*a* on the upper side of the lower electrode plate 302 along the longitudinal direction thereof, two V-shaped grooves 303*a* and 303*a* are formed parallel to each other, via a die, along the longitudinal direction of the lower electrode plate 302. This process may be performed by using a cutter or the like for slitting. In this case, by changing the slit width of the opening portion 302*a*, the pressing pressure sensitivity of the continuous-length switch can be changed.

Figure 40:
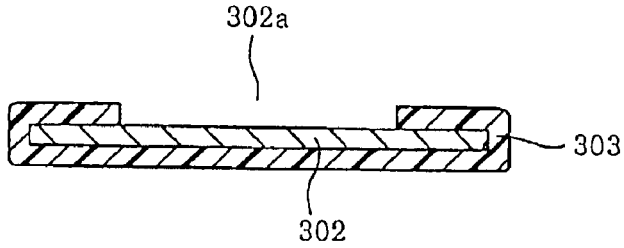
FIG. 40 is a sectional view illustrating a process of manufacturing the continuous-length switch according to the fourth embodiment of the present invention.

Next, as shown in FIG. 40, a part of the insulating material 303 on the upper side of the lower electrode plate 302 (the part of the area between the V-shaped grooves 303*a* and 303*a*) is peeled off along the longitudinal direction of the electrode plate to form the opening portion 302*a* on the upper side of the lower electrode plate 302 for contact.

Figure 41:
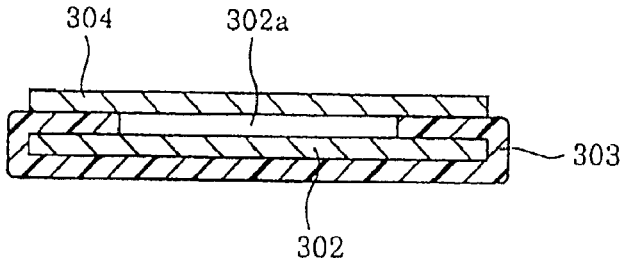
FIG. 41 is a sectional view illustrating a process of manufacturing the continuous-length switch according to the fourth embodiment of the present invention.
Figure 42:
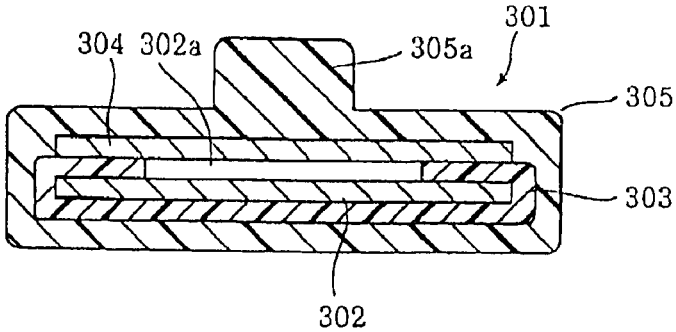
FIG. 42 is a sectional view of the continuous-length switch according to the fourth embodiment of the present invention.
Figure 43:
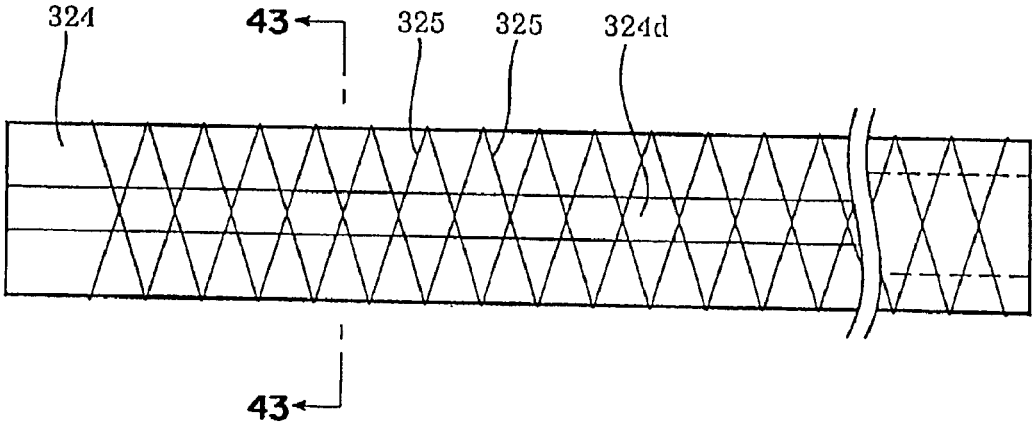
FIG. 43 (PRIOR ART)
FIG. 43 is a plan view of a conventional continuous-length switch.
Figure 44:
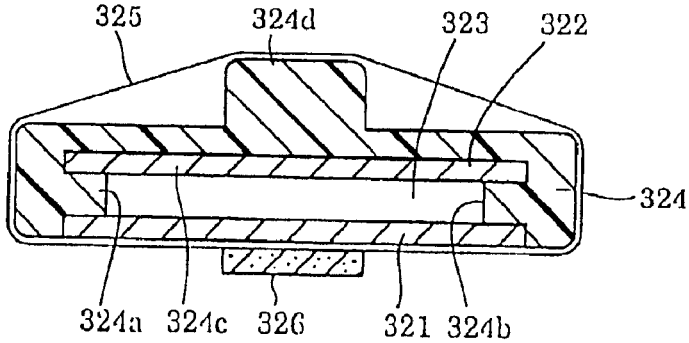
FIG. 44 (PRIOR ART)
FIG. 44 is an enlarged sectional view taken along the line 43—43 in FIG. 43.

Next, as shown in FIG. 41, the upper electrode plate 304 made of a continuous-length plate-like conductive material is placed on the insulating material 303 on the lower electrode plate 302 in which the opening portion 302*a* is formed. Then, these are inserted into a nipple (not shown), and an insulating material is extruded through the clearance between the nipple and a die (not shown) to form the jacket 305, having the protrusion 305*a* at the middle of the top thereof, extending along the longitudinal direction of the electrode plate and covering the entire circumferences of the insulating material 303 and the upper electrode plate 304 as shown in FIG. 42, so that the continuous-length switch 301 as shown in FIG. 42 is obtained.

In this case, by changing the geometry of the die, continuous-length switches 301 having a variety of sectional geometries can be obtained.

With the present embodiment as stated above, the lower electrode plate 302 and upper electrode plate 304 can be firmly held in place while the opening portion 302*a*, which provides a space region for a switching operation, is formed between the lower electrode plate 302 and the upper electrode plate 304, which results in a continuous-length switch 301 having excellent durability.

Further, with the manufacturing method according to the present embodiment as stated above, the manufacturing process can be simplified as compared to that for the above-mentioned conventional continuous-length switch, and, while the manufacturing cost is reduced, a manufacturing method which results in a continuous-length switch 301 having excellent durability can be realized.

With the present invention as described above in detail, the following effects can be obtained.

The invention as described above can offer a continuous-length switch which improves safety and reliability, allows man-hours in manufacturing to be reduced, and minimizes a power requirement.

The invention also can offer a continuous-length switch which improves safety and reliability, allows man-hours in manufacturing to be reduced, and minimizes power requirement, as described above, while lowering the mechanical strength of the electrode plate relative to an external force. This allows a highly sensitive switch to be achieved, and because the mechanical strength of the electrode plate can be lowered, a strong material can be adopted for use as the electrode.

The invention also can offer a continuous-length switch which provides the same effects as those expressed above, while the geometry of at least one electrode plate can be diversified.

The invention also can offer a continuous-length switch which is excellent in safety and reliability, and includes protrusions having a sectional geometry selected from various polygonal geometries. The various geometries include triangular, trapezoidal, circular, semi-circular, and oval geometries, which allows the switch to be wound around a drum or the like with generation of buckling of the electrode plate being suppressed. Therefore, operability of the switch is improved and a space requirement is reduced.

The invention also can offer a continuous-length switch which is excellent in durability, and will not fail after a long period of use.

The invention also can offer a manufacturing method which allows simplification of the manufacturing process and reduction of manufacturing costs, and yet results in a continuous-length switch which is excellent in durability.

What is claimed is:

1. A method for manufacturing a continuous-length switch, comprising:

extruding an insulating material to a uniform thickness onto a periphery of a first continuous-length plate-like conductive material, thereby providing a first electrode covered with an insulating material on a first surface thereof;

removing a portion of said insulating material from said first surface of said first electrode along a longitudinal direction of said first electrode so as to provide an exposed portion of said first electrode;

placing a second electrode on said insulating material and over said exposed portion of said first electrode; and extruding a jacket of insulating material around said second electrode and said insulating material such that a protrusion is formed over a central portion of said second electrode.

2. The method according to claim 1, wherein removing a portion of said insulating material from said first surface of said first electrode comprises forming two parallel grooves in said insulating material which extend along a longitudinal direction of said first continuous-length plate-like conductive material, and peeling from said first continuous-length plate-like conductive material in the longitudinal direction thereof said insulating material existing between said two parallel grooves so as to provide an exposed portion of said first continuous-length plate-like conductive material.

3. The method according to claim 2, wherein placing a second electrode on said insulating material and over said exposed portion of said first electrode comprises placing a second continuous-length plate-like conductive material on said insulating material and over said exposed portion of said first continuous-length plate-like conductive material.

4. The method according to claim 3, wherein said first continuous-length plate-like conductive material corresponds to an upper electrode plate, and said second continuous-length plate-like conductive material corresponds to a lower electrode plate.

5. The method according to claim 1, wherein placing a second electrode on said insulating material and over said exposed portion of said first electrode comprises placing a second continuous-length plate-like conductive material on said insulating material and over said exposed portion of said first continuous-length plate-like conductive material.

6. The method according to claim 5, wherein said first continuous-length plate-like conductive material corresponds to an upper electrode plate, and said second continuous-length plate-like conductive material corresponds to a lower electrode plate.

7. The method according to claim 1, wherein said first electrode corresponds to an upper electrode, and said second electrode corresponds to a lower electrode.

* * * * *